United States Patent [19]

Haviland

[11] 4,007,704

[45] Feb. 15, 1977

[54] GASKET MATERIAL APPLICATOR

[75] Inventor: Girard S. Haviland, West Hartford, Conn.

[73] Assignee: Loctite Corporation, Conn.

[22] Filed: Feb. 14, 1975

[21] Appl. No.: 549,865

[52] U.S. Cl. ..... 118/6; 118/319

[51] Int. Cl.[2] ..... B05C 13/00; B05C 5/00

[58] Field of Search ..... 118/6, 319, 500, 8, 118/410, 7; 269/55, 57; 425/246, 814; 51/134, 237 T

[56] References Cited

UNITED STATES PATENTS

| | | | |
|---|---|---|---|
| 2,550,335 | 4/1951 | Dailey | 118/319 |
| 2,708,899 | 5/1955 | Rudolph | 118/500 |
| 2,880,697 | 4/1959 | Blanding et al. | 118/8 |
| 3,029,776 | 4/1962 | Proskauer | 118/319 |
| 3,153,882 | 10/1964 | Millhiser | 118/319 |
| 3,342,158 | 9/1967 | Bennett et al. | 118/7 |
| 3,403,658 | 10/1968 | Damm et al. | 118/7 |
| 3,492,146 | 1/1970 | Kornaker | 118/8 |
| 3,575,131 | 4/1971 | Lohmann | 118/8 |

*Primary Examiner*—Mervin Stein
*Attorney, Agent, or Firm*—Watson, Cole, Grindle & Watson

[57] ABSTRACT

A turntable is supported for rotation as well as for radial movement in a plane transverse to its rotational axis so that, while rotating, the periphery of a non-circular cam wheel which rotates together with the turntable may be maintained in operative driven engagement with the periphery of a drive wheel which is rotated at a constant angular velocity. A material extruding nozzle is positioned to extrude gasket forming material onto a work piece carried by the turntable at a fixed location which is in registry with the point of driven engagement between the drive wheel and the cam wheel, so that the material is uniformly applied to the work piece in a path which conforms to and is in registry with the periphery of the cam wheel.

10 Claims, 4 Drawing Figures

GASKET MATERIAL APPLICATOR

This invention relates to improvements in a mechanism for applying a viscous material, such as a gasket forming compound, in the form of an extruded bead to a work piece in a predetermined path or conformation.

It is a primary object of the invention to provide for moving the work piece beneath a fixed extrusion nozzle from which the gasket forming material is extruded at a constant rate, the movement of that portion of the work piece immediately beneath the nozzle being at a constant linear velocity and along a predetermined path conforming accurately to the intended configuration of the completed gasket. The bead of material extruded by the nozzle onto the work piece is accordingly of constant thickness and cross sectional area so that when the work piece is assembled to a mating piece and the gasket material is compressed between said pieces, the resulting gasket will have an increased capability to withstand pressures without leakage.

It is a further incidental object of the invention to insure application of the bead of gasket material to the work piece in the form of a completely closed loop by providing for a slight overlap in the relative path pursued by the nozzle over the work piece, during their relative movement, whereby to compensate for any delay in commencing of the actual extrusion of material onto the work piece at the time the movement of the work piece is initiated.

SUMMARY OF THE INVENTION

With the foregoing objects in mind, the invention comprises a turntable on which the work piece is fixedly supported, the turntable being supported for rotation about an axis and for movement in the plane of said axis but transversely thereto. A cam wheel connected to the turntable for said rotation and movement therewith has its periphery surrounding the rotational axis of the turntable at varying distances therefrom, and a drive means has a portion moving at a constant linear speed in driving engagement with the periphery of the cam wheel at a fixed first location in the aforementioned plane, there being means yieldably urging the cam wheel into driven peripheral engagement with the drive wheel. The material extrusion nozzle of the applicator is arranged to extrude the gasket forming material onto the work piece at a fixed second location in the said plane which is equidistant with the first location from the rotational axis, or in other words is aligned with the first location in a direction parallel to the rotational axis of the turntable and work piece. Because of this the material applying nozzle deposits a bead of viscuous material onto the work piece in a path or pattern conforming precisely in configuration to and in registry with the periphery of the cam wheel, and at a constant linear speed corresponding to that of the cam wheel periphery.

A novel braking and resetting mechanism permits rotation of the turntable slightly in excess of one revolution, to insure closing of the endless loop of material, and then returns it to its starting point in readiness for another cycle of operation.

In the accompanying drawing and description, there is disclosed in detail the preferred embodiment of the invention. However by such specific description it is by no means intended to limit the invention in any way, except as might be required by the appended claims.

DESCRIPTION OF THE FIGURES OF DRAWING

DESCRIPTION OF THE PREFERRED EMBODIMENT

Figure 1:
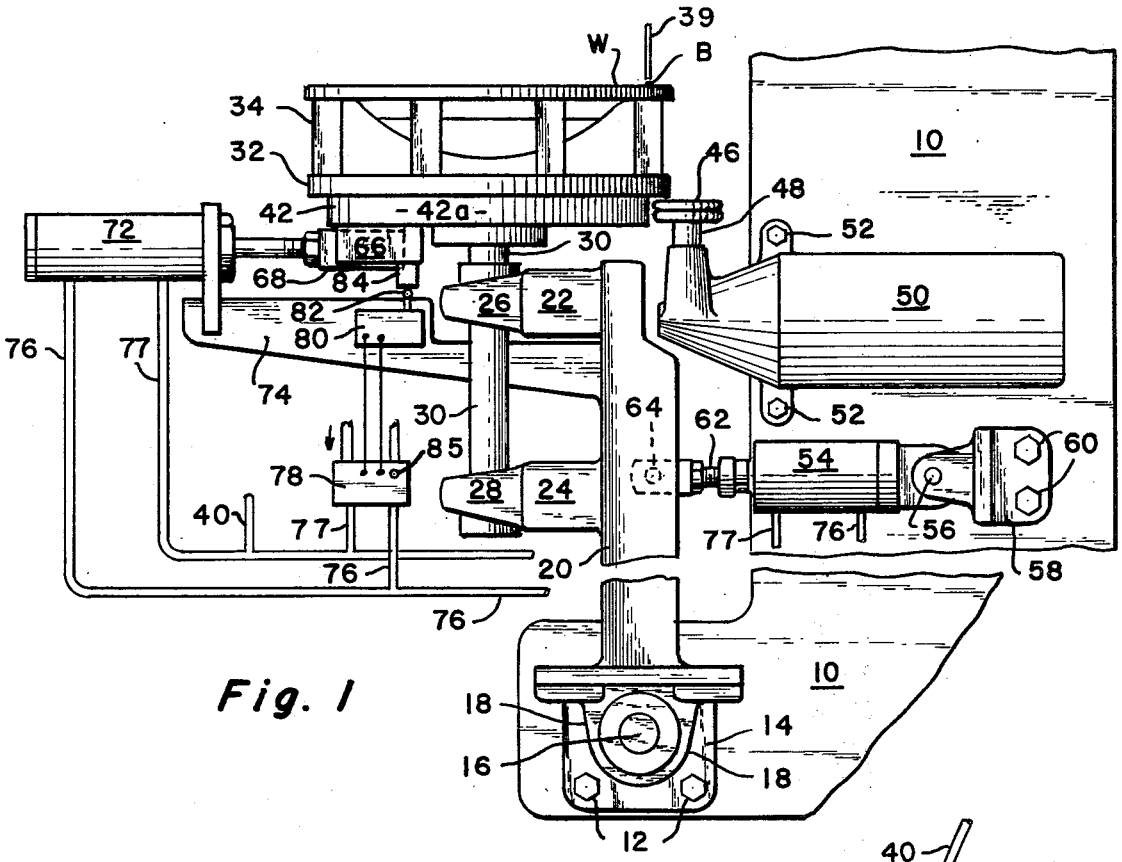
FIG. 1 represents a front elevation of mechanism embodying the invention, with certain parts omitted and broken away for purposes of clarity.

Referring now in detail to the accompanying drawing and first considering FIGS. 1 and 2 thereof, the numeral 10 therein designates a suitable supported vertical rigid plate which exemplifies a supporting frame for the components hereinafter described. Affixed to the frame 10 by means of bolts 12 is a bracket 14 which fixedly supports a horizontally disposed shaft 16.

Mounted on the shaft 16 by means of a bearing 18 at its lower end, is an upwardly projecting rigid support 20 which is swingable about the horizontal axis defined by the shaft 16.

Upper and lower arms 22 and 24 rigidly affixed to the support 20 provide fixed support for upper and lower bearings 26 and 28 through which is rotatably journalled a substantial vertical shaft 30. At the upper end of shaft 30 is supported a turntable 32 which is generally concentric to the rotary axis of the shaft 30.

It will thus be apparent that the turntable 32, its shaft 30 and the support 20 are swingable as a unit in a vertical plane about the horizontal axis defined by the shaft 16. The swingable support 20 thus exemplifies means rotatably supporting the turntable for movement in a predetermined path transversely to its axis of rotation and in the plane of said axis.

The turntable provides a rotary support for a work piece W, to the upwardly presented surface of which it is desired to apply an endless band or bead of suitable viscous material of non-circular configuration, or in other words of a configuration in which portions of the band or bead are at relatively varying distances from the rotational axis defined by the shaft 30. Such a bead is indicated at B in FIG. 1.

In the illustrated embodiment, the work piece W is fixedly supported on the turntable 32 by means of the upwardly directed studs 34, in such manner that the upwardly presented flat surface of the work piece, on which the gasket forming material B is applied, is in a radial plane with respect to the rotational axis of the shaft 30 and turntable 32.

Figure 2:
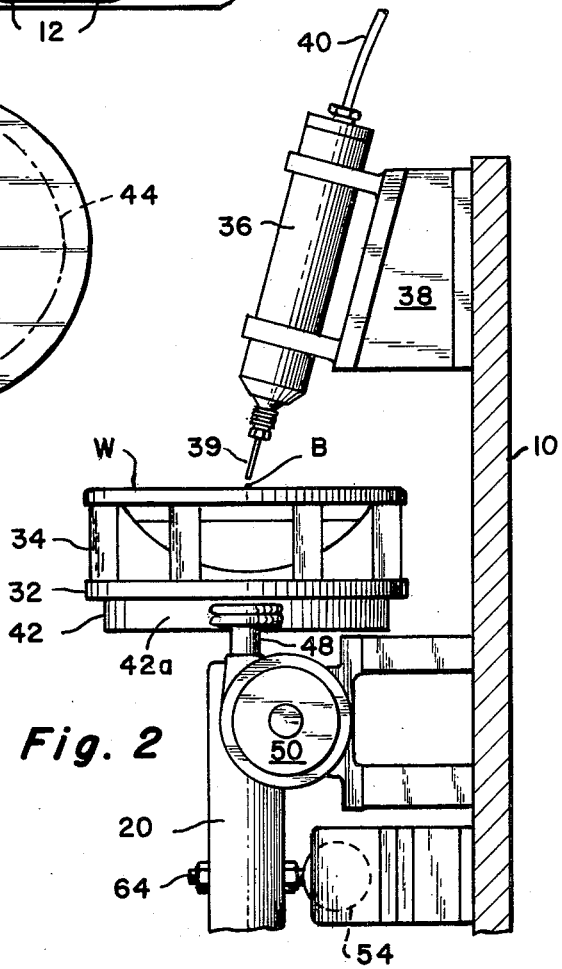
FIG. 2 is a side elevation of the structure shown in FIG. 1, showing in detail the position of the material applicator device, a portion only of which is shown in FIG. 1.

Referring to FIG. 2, the band or bead B of viscous gasket forming material is extruded onto the upper surface of the work piece W during rotation of the latter, by a generally conventional applicator 36 fixedly supported from the plate 10 by means of a bracket 38. As above indicated the applicator 36 is of generally conventional construction and is adapted to contain a supply of the gasket forming material, which is extruded under pressure through the extrusion needle or nozzle 39 of the applicator by a constant pneumatic pressure supplied through the conduit 40 from any suitable source (not shown). It will be understood that the viscous gasket forming material within the applicator 36 is homogeneous or of uniform consistency, and the arrangement of the applicator is such that as compressed air or gas is supplied to the upper end of the applicator at uniform pressure through the conduit 40, this will produce a constant rate of extrusion of a continuous bead or band of such material directly onto the surface of the work piece W, it being noted that the discharge end of the extrusion needle or nozzle 38 terminates just above such surface.

It will be understood that the extrusion of the material from the applicator 36 will normally be controlled by conventional means, (not illustrated) constituting no part of the present invention, in such manner as preferably to permit discontinuance of the extrusion operation after the endless band of material has been applied to each work piece, and resumption of the extrusion when the work piece is replaced by a further work piece and rotation of the turntable and work piece is resumed. Where, as in the preferred embodiment, the extruded band or bead of material applied to the work piece is to be compressed between the work piece and a mating piece or member to form a gasket for sealing the joint or interface between said work pieces, it is of primary importance that the bead B of material be of uniform thickness and cross sectional area in order to obtain its maximum sealing ability.

For attaining this end a drive means is provided for rotating the turntable 32 and work piece W in such manner that although the angular velocity of the turntable and work piece about the axis of shaft 30 may vary, the zone or band on the work piece to which the material is supplied will move past the applicator nozzle or needle at a constant linear speed or velocity.

To this end, there is suitably affixed to the under side of the turntable and/or to the shaft 30 a cam wheel 42, the radially outwardly presented peripheral edge 42a of which encircles the shaft and has a shape or outline conforming to the configuration desired in the endless band of material to be applied to the work piece W.

Figure 3:
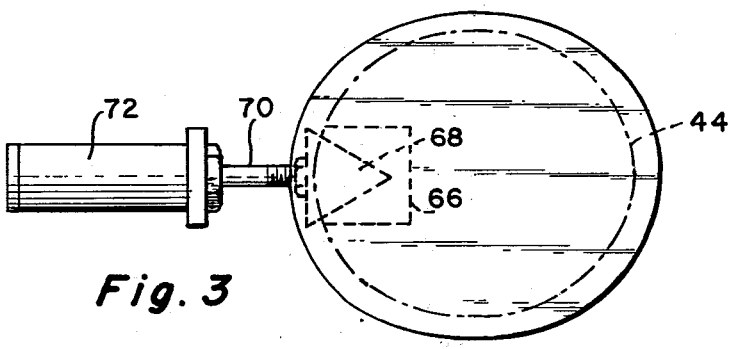
FIG. 3 is a generally diagrammatic plan view of the braking and resetting means of the turntable shown in the proceeding figures.

This is illustrated by way of exemplification in FIG. 3 in which the broken line 44 indicates the path or configuration of the endless band or bead of gasket forming material as applied to the work piece, the material in this instance being applied in a substantaially elliptical configuration, in vertical registry with the similarly conformed peripheral edge 42*a* of the cam wheel.

Rotation is imparted to the wheel 42, turntable 32 and work piece W, by means of a drive wheel 46 fixed to the output shaft 48 of a constant speed, preferable electric gear motor 50 which is mounted at 52 on the supporting frame 10.

Where a friction drive is employed between the wheels 46 and 42, the normally interengaged smooth peripheries of the friction drive wheel 46 and of the driven cam wheel 42 will have a sufficiently high coefficients of friction as to impart the drive from one to the other without any material or consequential amount of slippage. Alternatively, the wheels 42 and 46 may be provided with intermeshing gear teeth of uniform pitch.

As above indicated, the lower end of the extrusion needle 39 of the applicator 36 will normally be positioned just above the upper surface of the work piece W at a location in vertical registry with the point of tangency, or in other words the point of driving engagement between the driving and driven wheels 46 and 42, respectively. Thus as the driven wheel 42 is rotated, while maintaining its periphery 42*a* in the engagement with the drive wheel 46, the rotational axis of the driven wheel and thus of the turntable 32 and work piece W will move toward and away from the wheel 46 in accordance with variations in radius of the frictional cam surface 42*a*.

For yieldably urging the cam wheel periphery 42*a* into frictional driven engagement with the drive wheel 46, there is provided means, such as illustrated in FIG. 1, in the form of a pneumatic double acting cylinder and piston unit, the pneumatic cylinder 54 of which is pivotally connected at 56 to a bracket 58 which is affixed by bolts 60 to the base plate of frame 10 of the apparatus. The piston rod 62 of the unit is pivotally connected at 64 to the swingable support 20, whereby extension and contraction of the unit will exert a force on the arm 20 tending to move it angularly about its shaft or pivot 16.

As above indicated, the primary function of the pneumatic piston and cylinder unit 54 is to exert a yielding force on the support 20 for maintaining the cam surface 42*a* of the driven friction wheel in frictional driven engagement with the drive wheel 46, while the support 20, the driven wheel 42, turntable 32 and work piece W, all move radially toward and away from the rotational axis of the driven wheel 46 in accordance with variations in radius of the peripheral edge 42*a* of the driven wheel.

It will be apparent that discontinuance of the drive may readily be achieved, either by deenergizing the constant speed motor 50, or by actuating the pneumatic piston and cylinder unit 54 so as to project the piston rod 62 thereof to the left in FIG. 1 and thereby to retract the periphery 42*a* of the driven wheel from frictional driven engagement with the drive wheel 46.

It will be understood that in the preferred embodiment, the pneumatic piston and cylinder unit 54 is of the double acting type controllable by means of a conventional valve mechanism (hereinafter more fully described) to selectively swing the support arm 20, either in a clockwise or counterclockwise direction, so as to either engage or disengage the frictional drive between the wheel 42 and 46.

Although the frictional engagement between the wheels 42 and 46 may be manually selectively controlled, to cause rotation of the work piece for a complete revolution while the gasketing material, caulking compound and the like is applied to the work piece to form an endless bead or band of material thereon, it is preferable to provide automatic means for achieving this function. In the preferred embodiment, such means is designed to commence rotation of the turntable and work piece from a predetermined starting point and to automatically bring it to rest at precisely the same starting point. However due to the fact that in known forms of gasket material applicators such as 36, even though means is provided for energizing the applicator simultaneously with the commencement of rotation of the work piece, there is frequently a slight lag between the time the rotation of the work peice commences and the time that the extrusion of material onto the work piece is commenced, so that if the rotation of the work piece is restricted to 360°, there may be a slight gap between the ends of the band or bead or gasket material thus applied. The resulting gasket may accordingly be defective.

With this in mind the present invention provides for rotating the work piece slightly in excess of 360° or in other words for rotating it slightly past its starting point so as normally to provide a slight overlap between the ends of the bead of material and then reversing its rotary movement to return it to its starting point.

Figure 4:
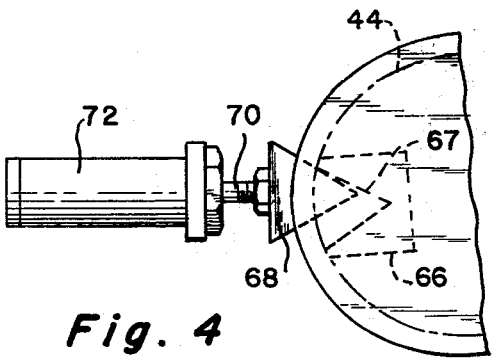
FIG. 4 is a fragmentary view similar to FIG. 3 showing the parts in a different operational position.

For this purpose, and as is best illustrated in FIGS. 3 and 4 in conjunction with FIG. 1, there is affixed to the cam wheel 42 a block 66 defining a V-shaped notch 67, extending radially thereinto for coaction with a generally wedge shaped braking and resetting element 68 carried at the free end of the piston rod 70 of a pneumatic piston and cylinder unit, the cylinder 72 of which is fixedly supported as shown in FIG. 1, by a rigid arm 74 fixed to and constituting part of the support 20. The unit 70, 72 of the preferred embodiment is of a well known double acting type, generally similar to the unit 54, in which the piston rod 70 and brake element 68 may be selectively projected and retracted. When projected in properly timed relation to the rotation of the turntable, the braking element 68 will be operatively received in the notch 67 of block 66, the timing being such that after the turntable has rotated for slightly more than a complete revolution the wedge-shaped braking element 68 engages the trailing side wall of the notch as shown in FIG. 4. Thereafter as the element 68 is fully projected, the resulting inclined plane action between the interengaged sloping sides of the notch and of the element will return the turntable back to its starting point in which the positions of the parts will be as indicated in FIG. 3.

As is illustrated in FIG. 1, pressurized air for controlling both of the power units 54, 72 is supplied to and withdrawn from the respective units by means of the conduits 76 and 77 communicating with both units, on opposite sides of the conventional pistons within said units. Therefore, when pressurized air is delivered through the conduit 76 to the relatively remote ends of the units 54 and 72 and air is allowed to escape through the conduits 77, the pistons and their piston rods 70 and 62 of the respective units will be projected. On reversal of the directions of air flow through the respective conduits 76 and 77, the pistons and piston rods of the respective units will be retracted.

For thus controlling the flow of air through these conduits, there is interposed in them a conventional solenoid actuated reversing valve 78 connected in circuit to a micro-switch 80, the control arm 82 of which is positioned for engagement and actuation by a boss or lug 84, depending from the block 66 and hand wheel 42, at a location to engage and trip the actuating arm 82 at the completion of each revolution of the cam wheel, at a time when the notch 66 is disposed for reception of the braking element 68. The braking element 68 is caused to be automatically projected at the appropriate time by the resulting actuation of the micro-switch 80 and the solenoid actuated valve 78 controlled by said switch.

Simultaneously with the projection of the piston rod 70 and braking element 68 of the unit 72, the unit 54 is also actuated by air pressure delivered through conduit 76 (and withdrawn through the conduit 77). Thus the support 20 is swung in a counterclockwise direction to discontinue the frictional driving engagement of the cam wheel 42 by the drive wheel 40.

The parts are thus brought to rest in a predetermined position in which a completed work piece may be removed and replaced by a fresh work piece whenever necessary.

In order to provide for retraction of the piston rod 62 and 70, to thus reestablish the driving engagement of the wheels 46 and 42 and release of the brake element 68, the micro-switch 80 is provided with a manually operable push button 85 which, when actuated, causes the micro-switch 80 to actuate solenoid valve 78 so as to reverse the relative flow directions through the conduits 76 and 77, whereby the brake 68 is disengaged and simultaneously therewith, the cam wheel 42 is again brought into frictional driving engagement with the drive wheel 46.

If desired, the air supply conduit 40 of the applicator may communicate with conduit 77 and supply pressurized air to the applicator 36 under the control of the solenoid valve 78, so as to continue and discontinue the extrusion of material from the applicator nozzle, substantially, simultaneously with starting and stopping of the rotary movement of the work piece.

The overall operation of the invention is believed to be apparent from the foregoing detailed description. With the turntable and work piece at rest and held in predetermined position by the brake element 68 and with the frictional drive disengaged, the work piece may be affixed to the turntable supports 34 by any suitable attaching means (not shown) or, if of sufficient weight, may be held in place simply by the combined effects of gravity and friction. Then, by manual actuation of the push button 85 of micro-switch 80, the brake element 68 may be released and the driving wheel 46 engaged with the cam wheel 42 to commence rotation of the work piece beneath the stationery applicator 36. At the same time the delivery of pressurized air to the upper end of the applicator 36 will cause the same to commence extrusion of material onto the work piece substantially simultaneously with the beginning of rotation of the latter.

Thereafter the air pressure to the applicator being constant, material will be extruded at a constant rate in the form of a bead onto the work piece. Since the application of this bead of material is in vertical registry with the point of driving engagement between the drive wheel 46 and the driven cam wheel 42, and since the drive wheel 46 is rotated at a constant rotational speed, the resulting bead of material deposited on the work piece will be of uniform cross sectional area. The rotation of the turntable and work piece will continue for very slightly in excess of a complete revolution, before their rotation is interrupted by projection of the brake element 68 into engagement with the trailing side of the V-shaped notch 67, (as in FIG. 4) so that the subsequent continued projection of the braking element 68 to its final position in the notch 67 will return the turntable to its predetermined starting point as in FIG. 3. The slight amount of movement thus permitted in excess of a complete revolution of the work piece will thus normally cause a very slight overlap between the ends of the deposited bead of material and will insure that the deposited band or bead of material is completely closed, so as to leave no gap through which leakage might occur when the material is used to form a gasket.

In a modified arrangement (not illustrated), a time delay switch, operated by pushbutton 85, could be inserted between items 78 and 80. In such an embodiment, the rotation of the turntable and work piece will continue after their rotation is sensed by the micro-switch 80 and time delay element. When the time delay times out, the table is tipped to the left by cylinder 59, thus disengaging the friction drive. Simultaneously, cylinder 72 projects wedge 68 to turn the table back to its starting point.

Having thus described my invention I claim:

1. The combination comprising:

a turntable having means for fixedly supporting a work piece;

means supporting said turntable for rotation about a rotational axis and for movement in a plane extending in a direction transverse to said rotational axis, said supporting means including a support arm and means supporting said arm for swinging movement about an axis normal to said plane, said turntable being rotatably supported by said support arm at a location remote from said last mentioned axis;

a cam wheel connected to said turntable for rotation therewith and for movement therewith in said plane;

said cam wheel having a peripheral edge surrounding said rotational axis at varying distances therefrom;

a drive means having a portion moving at a constant linear speed in driving engagement with said peripheral edge of the cam wheel at a fixed first location in said plane; and means yieldably urging said cam wheel into peripheral driven engagement with said drive means.

2. The combination of claim 1 including a material extrusion nozzle positioned to extrude material on to said work piece at a fixed second location in said plane equidistant with said first location from said rotational axis of the turntable.

3. The combination of claim 2 in which said drive means comprises a drive wheel of constant radius rotatable about a fixed axis with its periphery in driving engagement with the (periphery) peripheral edge of said cam wheel at said first location, and means for rotating said drive wheel at a constant angular velocity about its said fixed axis.

4. The combination of claim 2 in which said support arm is a rigid member.

5. The combination of claim 3 in which the periphery of said drive wheel is in frictional driving engagement with the peripheral edge of said cam wheel.

6. The combination of claim 2 including means for arresting the rotation of said turntable and said cam wheel at a predetermined angular position upon completion of each revolution thereof.

7. The combination of claim 4, including a brake block supported by said cam wheel and formed with an outwardly opening V-shaped notch therein, in combination with a braking element of complemental wedge configuration for reception in said V-shaped notch, means supporting the said breaking element for projection into and retraction from said notch; and means timed to project said braking element into said notch after completion of each revolution of the cam wheel, and into engagement with the sloping trailing side of said V-shaped notch to thereby reverse the rotation of the cam wheel.

8. The combination of claim 7 in which said last mentioned means timed to project said braking element comprises a pneumatic cylinder piston unit including a piston rod on which said braking element is supported for movement into and retraction from said notch.

9. The combinaton of claim 8 in which said means for yieldably urging the turntable and cam wheel towards said drive means comprises a pneumatic cylinder and piston unit.

10. The combination of claim 9 including automatically actuated means for simultaneously actuating the respective pneumatic piston and cylinder units.

* * * * *